US006149014A

United States Patent [19]

Mankosa et al.

[11] Patent Number: 6,149,014

[45] Date of Patent: Nov. 21, 2000

[54] MILL MAGNET SEPARATOR AND METHOD FOR SEPARATING

[75] Inventors: Michael J. Mankosa, Erie; Marshall A. Carner, Fairview; Daniel A. Norrgran, Erie, all of Pa.

[73] Assignee: Eriez Manufacturing Co., Erie, Pa.

[21] Appl. No.: 09/203,834

[22] Filed: Dec. 1, 1998

Related U.S. Application Data

[60] Provisional application No. 60/067,500, Dec. 4, 1997.

[51] Int. Cl.[7] ..... B03C 1/00

[52] U.S. Cl. ..... 209/223.2; 209/214; 209/225; 209/636

[58] Field of Search ..... 209/213, 214, 209/223.1, 223.2, 225, 228, 231, 636

[56] References Cited

U.S. PATENT DOCUMENTS

| | | | |
|---|---|---|---|
| 2,332,701 | 10/1943 | Dowsett | 83/94 |
| 2,607,478 | 8/1952 | Newton | 209/223.2 X |
| 3,179,345 | 4/1965 | Kivert et al. | 241/30 |
| 3,856,666 | 12/1974 | Yashima et al. | 209/219 |
| 3,947,349 | 3/1976 | Fritz | 209/225 X |
| 4,013,233 | 3/1977 | Kylund | 241/80 |
| 4,062,497 | 12/1977 | Kemp, Jr. et al. | 241/34 |
| 4,726,531 | 2/1988 | Strasser | 241/19 |
| 4,781,821 | 11/1988 | Salmi | 209/214 |
| 5,092,986 | 3/1992 | Feistner et al. | 209/212 |
| 5,110,056 | 5/1992 | Blasczyk et al. | 241/19 |
| 5,394,991 | 3/1995 | Kumagai et al. | 209/212 |
| 5,462,173 | 10/1995 | Darling | 209/223.2 X |
| 5,462,234 | 10/1995 | Patzelt et al. | 241/19 |

FOREIGN PATENT DOCUMENTS

| | | | |
|---|---|---|---|
| 1338893 | 9/1987 | U.S.S.R. | 209/223.2 |
| 1808386 | 4/1993 | U.S.S.R. | 209/223.2 |

*Primary Examiner*—Tuan N. Nguyen
*Attorney, Agent, or Firm*—Lovercheck and Lovercheck

[57] ABSTRACT

A top feed, wet drum magnetic separator capable of treating, removing tramp metal from the full flow discharge of a grinding mill having a feed box which provides overflow capacity, velocity break to minimize turbulence, and spread the slurry evenly across the drum surface. A flow transition is provided to the rotating drum surface. A fixed magnet assembly is supported inside the drum. Barrier walls contain the flow and a cover confines the flow over the drum. A partitioned product hopper collects metallic fragments separately from the bulk slurry flow. A spray bar is provided to clean the drum.

24 Claims, 2 Drawing Sheets

MILL MAGNET SEPARATOR AND METHOD FOR SEPARATING

REFERENCE TO PRIOR FILED APPLICATION

This application claims the benefit of U.S. Provisional Application Ser. No. 60/067,500 filed Dec. 4, 1997.

BACKGROUND OF THE INVENTION

The mining industry utilizes various devices to separate valuable minerals from host contaminants after extraction from the earth. Initially the ore preparation procedure involves crushing the run-of-mine rock from several feet in size down to approximately 1–3 inches. This preliminary crushing step is followed by one or more stages of grinding to reduce the ore to an average size less than 1 mm. These latter grinding steps typically use large rotating cylindrical mills containing a charge of spherical steel balls that are used as a grinding media. The balls are in a constant tumbling motion due to the rotation of the mill. The ore is fed into one end of the mill, it progresses through the grinding chamber and is discharged from the opposite end. As the ore progresses through the mill the grinding media impacts the material resulting in fracture and breakage of the individual pieces into smaller and smaller particles.

The tumbling motion of the ball charge can also result in fracture of the steel balls. Additionally, mechanical abrasion will wear the ball surface causing a reduction in size of the grinding media. The net result of this process is generation of various shapes of steel which are significantly smaller than the original spherical ball. A new grinding ball will typically range from 3 to 5 inches in diameter. The broken or worn ball components can be as large as a hemisphere of the original ball or fragments having dimensions of less than ¾ inch. Depending on the mill design, these fragments will discharge with the mineral and report to downstream equipment.

The ball fragments cause two distinct problems in ore processing facilities. The first, and most notable, is wear on subsequent equipment. Grinding is typically a wet process and the ore/water matrix is pumped between various unit operations. The metallic fragments cause significant wear on pumps, piping and other downstream equipment. The costs associated with maintenance downtime and equipment rebuild can be substantial. Secondly, and less recognized, is the effect of the ball fragments on mill efficiency. The circuit design for most grinding operations is such that the ball fragments that discharge the mill will return with the new feed to the grinding circuit. As a result, a substantial build-up of fragments can occur in the grinding mill occupying volume that would otherwise be filled by mineral slurry. This loss in active mill volume can de-rate the mill capacity by as much as 10%. Furthermore, the small mass of the fragments does not provide a sufficient impact force to effectively fracture the mineral particles in the mill.

Applicant is aware of the following U.S. Pat. Nos. 2,332,701; 3,179,345; 3,856,666; 4,013,233; 4,062,497; 4,726,531; 4,781,821; 5,092,986; 5,110,056; 5,394,991; and, 5,462,234.

U.S. Pat. No. 2,332,701 recognizes the problem presented by worn and fragmented grinding media in ball mills. This ball mill continuously discharges grinding media with the ground material and return to the feed end of the mill only that portion of the grinding media which is in good condition and of the correct size. A trommel screen sorts the output and an elevator conducts the useful grinding media back to the feed end of the mill. This patent does not address the problem of separation of metallic contaminants from the slurry discharge of an operating grinding mill.

SUMMARY OF THE INVENTION

Based on the above constraints a separator was developed to remove metallic contaminants from the slurry discharge of an operating grinding mill. As shown, slurry discharging from the grinding mill enters the feed box located on top of the separator. The feed box provides a velocity break, minimizes turbulence and spreads the mineral slurry evenly on the drum surface. The velocity break section should be large enough to provide overflow of feed material. The feed box is approximately the same width as the separator and is rubber lined to minimize wear.

It is an object of the invention to provide a magnetic separator capable of removing tramp metal from the discharge of grinding mills. The tramp metal in the mill product is a result of breakage and attrition of spherical steel grinding media used for commination.

It is an object of the invention to eliminate the presence of tramp metal which degrades mill performance and is detrimental to subsequent unit operations.

It is an object of this invention to provide a separator capable of treating the full-flow mill discharge with minimal change to the existing spatial configuration of the existing equipment. A top-fed, wet drum magnetic separator has been developed for this application.

It is another object of the present invention to provide a mill magnet separator that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
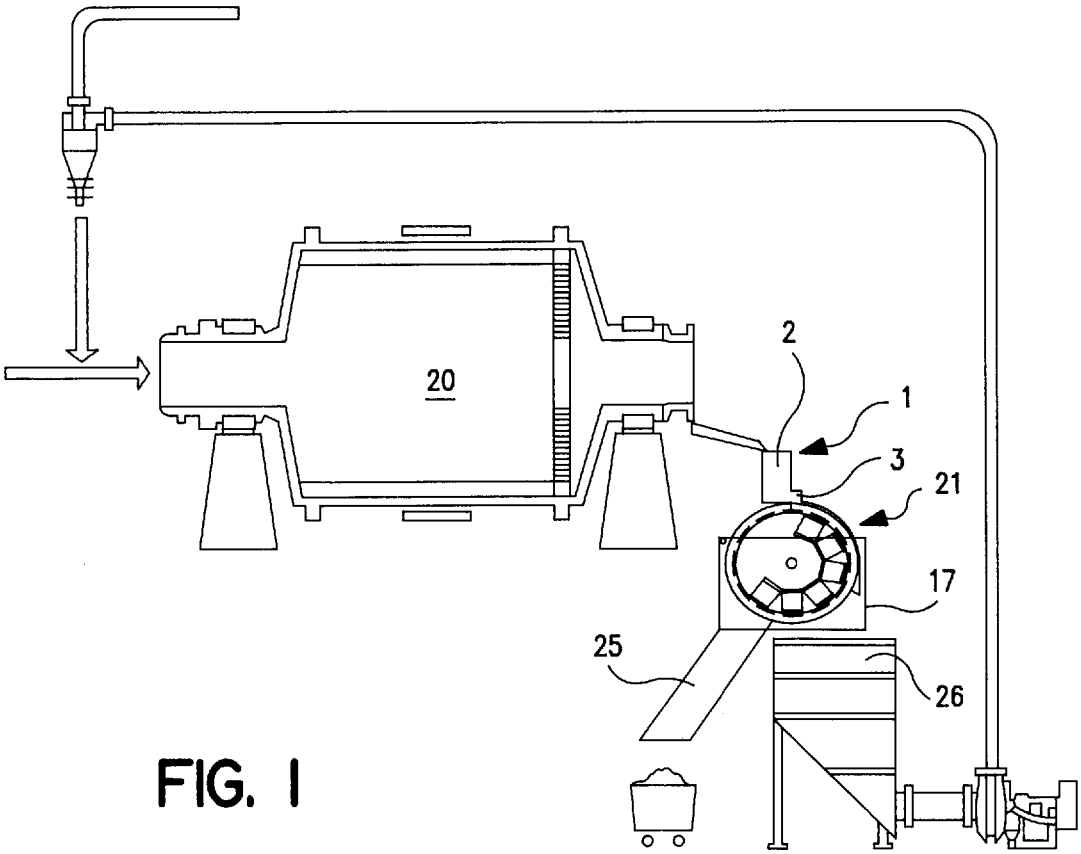
FIG. 1 is a cross sectional side view showing a grinding circuit with mill magnet according to the invention.
Figure 2:
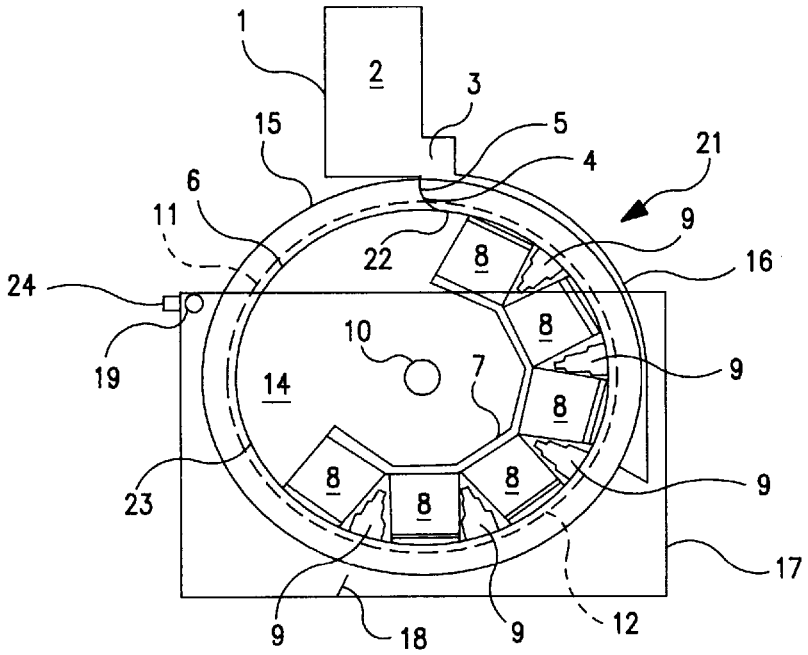
FIG. 2 is an enlarged cross sectional view of the mill magnet shown in FIG. 1 according to the invention.
Figure 3:
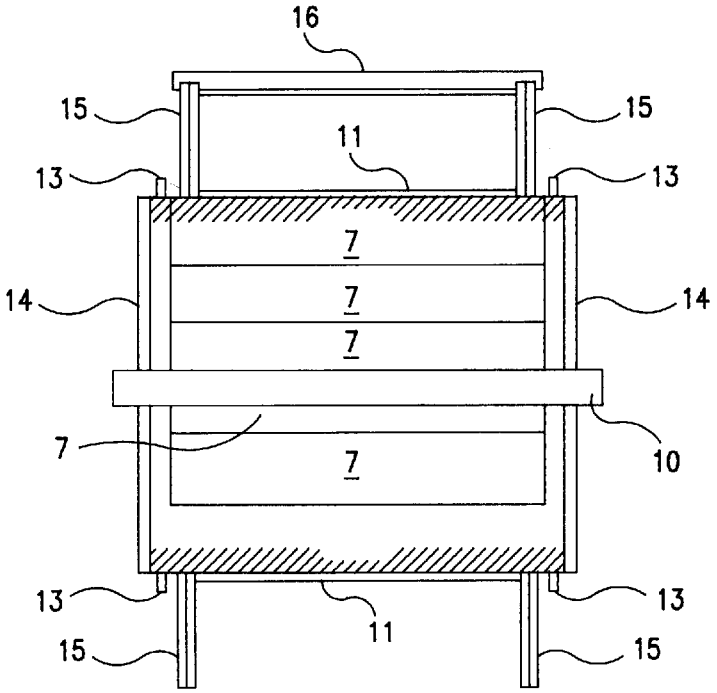
FIG. 3 is a cross sectional top view of the drum and cover showing the confining channel according to the invention.

Now with more particular reference to the drawings, a separator is provided to remove metallic contaminates from the slurry discharge of an operating grinding mill. Slurry discharging from grinding mill 20 enters feed box 1 located on top of separator 21. Feed box 1 has velocity break section 2 which provides a velocity break and minimizes turbulence and spreads the mineral slurry evenly on the outer surface of drum shell 6. Velocity break section 2 is made large enough to provide for overflow of feed material. Feed box 1 is approximately the same width as separator 21 and is rubber lined to minimize wear.

Feed introducer 3 provides a smooth transfer of slurry from feed box 1 to drum shell 6. Curved transition 4 is used with rubber flap 5 on final discharge edge 22 to provide a seal between feed introducer 3 and the outer surface of drum shell 6. Feed introducer 3 is located such that discharge edge 22 is at approximately the one o'clock position on drum surface 6.

Drum shell 6 is manufactured from non-magnetic stainless steel and may be, for example, thirty-six inches in diameter. Drum shell 6 rotates about fixed magnet assembly 7. Fixed magnet assembly 7 uses a combination of ferrite and rare-earth magnetic material consisting of six main poles 8 and five inter-poles 9 arranged in an arc from approximately 26 to 218.5 degrees (pole center-to-center). It should be recognized that various other magnetic circuit configurations can be used in this separator. Drum shell 6 rotates about fixed axis 10 at speeds up to 100 RPM. Rubber lining 11 is located on outer surface of drum surface 6 for wear protection. Cleat 12 is located on drum 6 to ensure transfer of metal fragments around drum surface 6 and discharge beyond the last pole. Multiple cleats may be provided. Cleat 12 should be at least one inch high and fabricated from a wear resistant material. Concentric lip 13 should be located on both ends of drum 23 to prevent slurry from leaking over drum end flanges 14.

Barrier walls 15 are located on drum surface 6 to contain the flow of mineral and water slurry. Barrier walls 15 are attached to and rotate with drum shell 6. Sealed, stationary cover 16 is located over channel barrier walls 15. Cover 16 is used to guide slurry around the curvature of drum 23, thus maintaining the slurry in contact with drum 23. Both barrier walls 15 and cover 16 are rubber lined to minimize wear.

Partitioned product hopper 17 is located around the lower portion of separator 21. Hopper 17 extends slightly beyond lower limit of slurry retainer wall and is configured with externally adjustable splitter 18 to partition metallic fragments from bulk slurry flow. Hopper 17 and splitter 18 are rubber lined to minimize wear and are manufactured from non-magnetic material. Drum spray bar 19 fabricated from steel pipe is located inside hopper 17 to remove solids that adhere to drum surface 6. Valve 24 is located on the outside of separator 21 to adjust the water flow rate.

The metallic fragments are directed through first discharge means 25 to a suitable place outside the mill cycle. The bulk slurry flow is directed through second discharge means 26 to return to the mill cycle.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A magnetic separator to remove magnetic contaminants from a slurry discharge of an operating grinding mill comprising:

a separator, a feed box on top of said separator and a partitioned product hopper around and below said separator;

said separator comprises a drum rotatable about an axis, a fixed magnet assembly inside the drum and a cover;

said drum having an outer generally cylindrical surface;

barrier walls attached to said drum surface and extend outwardly therefrom forming a channel for slurry flow;

said cover is supported over said barrier walls to guide the slurry around the curvature of said drum.

2. A magnetic separator to remove magnetic contaminants from a slurry discharge of an operating grinding mill comprising:

a separator, a feed box on top of said separator and a partitioned product hopper around and below said separator;

said separator comprises a drum rotatable about an axis and having an outer surface;

a fixed magnet assembly positioned inside the drum and adjacent the inside surface of the drum from a point adjacent a top of the drum to a point past a bottom of the drum;

said drum having an outer generally cylindrical surface;

said feed box comprises a velocity break section and a feed introducer section;

said velocity break section receives the slurry flow and spread it evenly across said separator;

said feed introducer provides a transition to said drum surface;

said transition comprises a flexible member having a final discharge edge which engages said drum surface.

3. A method of removing metallic contaminants from a slurry flow comprising the steps of:

minimizing the turbulence in the slurry;

spreading the slurry evenly across an outer surface of a rotating drum at a point adjacent the highest point of the drum;

rotating the drum with the flow of the slurry;

confining the slurry between a cover and the drum's outer surface;

separating the metallic contaminants from the slurry flow by magnets provided inside the rotating drum along an arc extending from generally the top of the drum to a point past the bottom of the drum;

conveying the bulk of the slurry to further processing;

conveying the metallic contaminates to a collecting place.

4. The method recited in claim 3 wherein all of the steps occur at the same time.

5. A magnetic separator to remove magnetic contaminants from a slurry discharge of an operating grinding mill comprising:

a separator, a feed box on top of the separator and a partitioned product hopper around and below the separator;

the separator comprises a drum rotatable about an axis, a fixed magnet assembly and a cover;

the drum having an outer generally cylindrical surface;

barrier walls attached to the drum surface and extend outwardly therefrom forming a channel for slurry flow;

a cover is supported over the barrier walls to guide the slurry around the curvature of the drum;

the feed box comprises a velocity break section and a feed introducer section;

the velocity break section receives the slurry flow and spreads it evenly across the separator;

the feed introducer provides a transition to the drum surface, the transition comprises a flexible member having a final discharge edge which engages the drum surface;

the partitioned product hopper comprises a container which receives the separated output from the separator;

a splitter is provided to separate the magnetic collection area and the nonmagnetic collection area.

6. The magnetic separator recited in claim 5 further comprising concentric lips fixed to the drum at each end of the outer surface and extending outwardly therefrom.

7. The magnetic separator recited in claim 5 further comprising sealing means to prevent leakage between the cover and the barrier walls.

8. The magnetic separator recited in claim 5 wherein the flexible member in the feed introducer is made of rubber.

9. The magnetic separator recited in claim 5 wherein the splitter is adjustable to optimize the separation of the magnetic fragments from the bulk of the slurry flow.

10. The magnetic separator recited in claim 5 wherein the feed box is approximately as wide as the separator.

11. The magnetic separator recited in claim 5 wherein the feed box is rubber lined to minimize wear.

12. The magnetic separator recited in claim 5 wherein the velocity break section is made with sufficient volume to accept and retain any overflow of feed material until such time as it can be processed.

13. The magnetic separator recited in claim 5 wherein the outer surface of the drum is rubber lined to minimize wear.

14. The magnetic separator recited in claim 5 wherein the drum is approximately thirty-six inches in diameter.

15. The magnetic separator recited in claim 5 wherein the drum is rotated at up to 100 RPMs.

16. The magnetic separator recited in claim 5 further comprising a cleat affixed to the outer surface and extending generally across the outer surface to assist the transfer of magnetic fragments.

17. The magnetic separator recited in claim 5 wherein the inner surface of the stationary cover is rubber lined.

18. The magnetic separator recited in claim 15 wherein the inner surfaces of the barrier walls are rubber lined.

19. The magnetic separator recited in claim 5 further comprising a spray bar, the spray bar directing a flow of water over the drum surface to clear material therefrom.

20. The magnetic separator recited in claim 5 further comprising a valve to control a water flow rate in a spray bar.

21. The magnetic separator recited in claim 5 wherein the hopper is made of non-magnetic material.

22. The magnetic separator recited in claim 5 wherein the splitter is made of non-magnetic material.

23. The magnetic separator recited in claim 5 wherein the inner surfaces of the hopper are rubber lined.

24. The magnetic separator recited in claim 5 wherein the splitter is rubber lined.

* * * * *